US010940398B2

(12) United States Patent
Smelcer

(10) Patent No.: US 10,940,398 B2
(45) Date of Patent: Mar. 9, 2021

(54) CONNECTING SYSTEM FOR DOLL, CLOTHING, AND ACCESSORIES

(71) Applicant: Erin M. Smelcer, Town & Country, MO (US)

(72) Inventor: Erin M. Smelcer, Town & Country, MO (US)

( * ) Notice: Subject to any disclaimer, the term of this patent is extended or adjusted under 35 U.S.C. 154(b) by 159 days.

(21) Appl. No.: 15/713,405

(22) Filed: Sep. 22, 2017

(65) Prior Publication Data

US 2018/0093196 A1 Apr. 5, 2018

Related U.S. Application Data

(60) Provisional application No. 62/399,125, filed on Sep. 23, 2016.

(51) Int. Cl.

| | |
|---|---|
| ***A63H 3/16*** | (2006.01) |
| ***A63H 3/10*** | (2006.01) |
| ***A63H 3/02*** | (2006.01) |
| ***A63H 3/36*** | (2006.01) |
| ***A63H 3/50*** | (2006.01) |
| ***A63H 3/52*** | (2006.01) |
| ***D05B 97/12*** | (2006.01) |
| ***A63H 3/44*** | (2006.01) |
| ***A63H 3/00*** | (2006.01) |

(52) U.S. Cl.

CPC ..... *A63H 3/16* (2013.01); *A63H 3/003* (2013.01); *A63H 3/02* (2013.01); *A63H 3/10* (2013.01); *A63H 3/365* (2013.01); *A63H 3/44* (2013.01); *A63H 3/50* (2013.01); *A63H 3/52* (2013.01); *D05B 97/12* (2013.01)

(58) Field of Classification Search

CPC ... A63H 3/02; A63H 3/08; A63H 3/10; A63H 3/14; A63H 3/52; A63H 3/16; A63H 3/365; A63H 3/44; A63H 3/50; D05B 97/12

See application file for complete search history.

(56) References Cited

U.S. PATENT DOCUMENTS

| | | | | | |
|---|---|---|---|---|---|
| 424,587 | A * | 4/1890 | Whitney | A63H 3/04 | 446/374 |
| 526,901 | A * | 10/1894 | Hoyt | A63H 3/08 | 446/98 |
| 1,183,149 | A * | 5/1916 | Wilks | A63H 3/16 | 446/121 |
| 1,364,881 | A * | 1/1921 | Koch | A63H 3/04 | 446/374 |
| 1,409,411 | A * | 3/1922 | Rogers | A63H 3/04 | 446/374 |

(Continued)

*Primary Examiner* — Eugene L Kim
*Assistant Examiner* — Alyssa M Hylinski
(74) *Attorney, Agent, or Firm* — Charles McCloskey

(57) ABSTRACT

A combination has a flat fabric doll with applied grommets for attaching reversible clothing and accessories. A doll head and torso joins by sewing to a front surface with arms and legs extending from beneath and adding depth to the doll. Grommets join to the torso and to reversible clothing. A brad or button threaded with pipe cleaner passes through the reversible clothing grommet and the doll torso grommet and exits the rear surface and bends for securement. A grommet applied above the head on the front surface receives a fabric loop for holding flat a doll during play. The invention also has another loop or label upon the rear surface that secures the doll to a stand by slipping over an upright pole of the stand.

11 Claims, 7 Drawing Sheets

(56) References Cited

U.S. PATENT DOCUMENTS 1,613,157 A * 1/1927 Blackwell ..... A63H 3/003 446/98
1,617,498 A * 2/1927 Pullman ..... A63H 3/10 446/98
1,621,231 A * 3/1927 Basinger ..... A63H 3/08 446/98
1,677,652 A * 7/1928 Peck ..... A63H 3/10 446/376
1,868,427 A * 7/1932 Moore ..... A63H 3/36 446/120
2,020,079 A * 11/1935 Rabel ..... A63H 3/12 446/297
2,027,352 A * 1/1936 Wessberg ..... A63H 3/10 446/98
2,093,207 A * 9/1937 Munson, Jr. ..... A63H 3/52 283/81
2,143,294 A * 1/1939 Whiting ..... A63H 3/08 434/395
2,193,447 A * 3/1940 Chloupek ..... A63H 3/08 446/100
2,202,036 A * 5/1940 Warren ..... A63H 3/36 446/120
2,206,950 A * 7/1940 Gregg ..... A63H 3/04 446/374
2,331,776 A * 10/1943 Heggedal ..... A63H 3/08 446/901
2,363,914 A * 11/1944 Wakefield ..... A63H 3/52 24/303
2,657,842 A * 11/1953 Smith ..... A47F 8/02 223/68
D195,069 S * 4/1963 Zuckerman ..... 223/85
3,102,360 A * 9/1963 Doyle ..... A63H 3/08 446/98
3,205,614 A * 9/1965 Brosk ..... A47G 25/28 223/87
3,475,852 A * 11/1969 Brosk ..... A47G 25/28 446/369
3,528,079 A * 9/1970 Birch ..... A63H 3/08 446/98
3,646,705 A * 3/1972 Nicholson ..... A63H 3/08 446/98
3,855,730 A * 12/1974 Baer ..... A63H 3/10 446/369
3,930,331 A * 1/1976 Simeone ..... A63H 3/02 446/369
4,122,628 A * 10/1978 Crowell ..... A63H 3/02 446/100
4,381,618 A * 5/1983 Krisel ..... A63H 3/16 428/16
4,403,000 A * 9/1983 Gates ..... G09F 7/12 156/279
4,563,373 A * 1/1986 Barnett ..... A47G 25/14 223/85
4,579,537 A * 4/1986 Leahy ..... A63F 9/12 446/100
4,808,139 A * 2/1989 Price ..... A63H 3/14 428/100
4,878,872 A * 11/1989 Johnson ..... A63H 3/00 446/321
4,904,220 A * 2/1990 Williams ..... A63H 33/006 446/227
4,911,670 A * 3/1990 McNicholas ..... A63H 3/52 434/429
4,925,423 A * 5/1990 Miller ..... A63H 3/52 446/370
5,021,020 A * 6/1991 Hambly ..... A63H 3/52 446/370
5,022,886 A * 6/1991 Jenkins ..... A63H 3/50 446/268
D331,268 S * 11/1992 Thurston ..... D21/645
5,178,573 A * 1/1993 Smith ..... A63H 3/08 428/16
5,201,443 A * 4/1993 Oswald ..... A47G 25/32 223/85
5,342,234 A * 8/1994 Bloom ..... A63H 3/02 446/268
5,538,166 A * 7/1996 Ogawa ..... A47G 25/28 223/85
5,626,503 A * 5/1997 Heftel ..... A63H 3/003 132/275
5,738,559 A * 4/1998 Ostrar ..... A63H 3/14 434/95
5,746,639 A * 5/1998 Bloom ..... A63H 3/02 446/369
5,779,516 A * 7/1998 Thorne ..... A63H 9/00 434/81
6,155,467 A * 12/2000 Chen ..... A47G 25/32 223/85
6,170,721 B1 * 1/2001 Chen ..... A47G 25/0671 223/85
6,233,763 B1 * 5/2001 Spaan ..... A47G 9/0207 446/72
6,475,054 B1 * 11/2002 Liu ..... A63H 3/10 446/387
6,712,667 B1 * 3/2004 Melzer ..... A63H 3/10 446/129
6,790,117 B2 * 9/2004 Ruiz Gonzalez ..... A63H 3/52 446/139
6,926,152 B2 * 8/2005 Leung ..... B65D 25/04 206/769
D513,563 S * 1/2006 Shaw ..... D6/316
7,306,096 B2 * 12/2007 d'Auriac ..... B65D 73/0014 206/301
7,900,827 B2 * 3/2011 Albers ..... A63H 3/52 235/380
D806,453 S * 1/2018 Viveiros ..... D6/674.1
2003/0176143 A1 * 9/2003 Ruiz Gonzalez ..... A63H 3/10 446/92
2005/0277358 A1 * 12/2005 Isenberg ..... A63H 3/08 446/147
2011/0220691 A1 * 9/2011 Kahn ..... A47G 25/1407 223/87
2012/0164366 A1 * 6/2012 Johnson ..... B44C 5/00 428/80
2012/0289117 A1 * 11/2012 Nielsen ..... A63H 3/16 446/100
2018/0093196 A1 * 4/2018 Smelcer ..... A63H 3/003

* cited by examiner

CONNECTING SYSTEM FOR DOLL, CLOTHING, AND ACCESSORIES

CROSS-REFERENCE TO RELATED APPLICATION

This non-provisional application claims priority to provisional application No. 62/399,125 filed on Sep. 23, 2016, all of which are owned by a common inventor.

BACKGROUND OF THE INVENTION

The connecting system for doll, clothing, and accessories generally relates to toys and more particularly flat fabric dolls. The present invention relates to flat fabric dolls with clothing items and accessories that attach and remove easily from the doll. The invention relates to a connecting system readily used by young children.

Dolls with interchangeable clothing have had popularity with children for years and years. While the initial purchase of the three-dimensional doll has its cost, the additional clothing and accessories to create a wardrobe can raise a doll's cost thereby limiting clothing choices for a doll and her user. The two-dimensional paper doll, flat fabric doll, and magnetic doll provide much enjoyment to young children for a child interchanges the pieces of clothing at a relatively low cost.

Although flat paper dolls have low cost, they ordinarily tend to bend, fold, crease, and tear during play. Flat paper dolls have decreasing ability to stand or lean against an object without falling. Repeated bending often leads to a limp paper doll or the complete detachment of a limb making the doll unusable. Clothing for traditional paper dolls comes from paper and paper like materials and attaches by bending a small outward extending paper tab around the doll figure. This attachment system does not allow for secure placement and clothes fall off during play. Further, due to excessive bending these tabs frequently tear off resulting in a useless clothing item. These issues of bending, tearing, and poor securement of additional clothing items often create frustration and disappointment during the play experience of the young child.

DESCRIPTION OF THE PRIOR ART

More recent flat fabric dolls solve some of the clothing attachment problems of traditional paper dolls through the use of hook and loop strips like Velcro®. In this system, either the hook portion or the loop portion attaches to the surface of the doll figure and the other piece attaches to the back of the clothing item. When pressed together the clothing item secures tightly to the doll. One problem arises when young children have difficulty separating the hook and loop system to detach the small pieces from the clothing and the small pieces do not allow for a sizeable grip. This can lead to a child's frustration and subsequent twisting and aggressive pulling that may separate the hook and loop fastener system from the doll base or item of clothing. The smaller the size of the hook and loop sections, the more difficulty they present to attach during doll assembly. As a result, this securement method for changeable clothing on small fabric dolls deters widespread usage in industry.

Some prior art flat fabric dolls have a design with a plastic stay or wire within the layers to allow for a degree of rigidity and support for the neck and head region when standing or leaning upright. This presents a problem to a user because over time the plastic stay or wire protrudes from beneath the fabric becomes a safety hazard to the child, or user.

Magnetic flat dolls have entered the market in recent years. Changeable clothing printed on a surface, backed with a magnetic layer, then secures to the doll base containing the magnetic pull allowing children to attach and detach clothing with ease. One drawback of magnetic flat dolls, as well as traditional paper dolls, remains that the dolls have complete two-dimensional form with permanently positioned arms and legs. These magnetic dolls thus lack the sensory and "real" feel associated with fabric dolls.

The present invention overcomes the disadvantages of the prior art and provides a connecting system for doll, clothing, and accessories that eliminates doll limpness and tearing, the inability to independently move arms and legs, and the unreliable and difficult means of securing interchangeable clothing items to the doll. Furthermore, the new and improved grommet system for attaching interchangeable clothing makes it possible for reversible clothing to expand the number of outfits and creative options during play. The present invention increases the enjoyment of the creative experience by using attractive fabrics and accessories, and strengthens the development of fine motor skills. The use of fabrics with vibrant colors, patterns and textures along with textile embellishments make this fabric doll visually and tactile stimulating resulting in an enhanced creative experience. The small size of the doll and the flexible fabric legs that extend beyond the firm base allows folding of the legs upwards decreasing the overall size of the doll to fit in a small bag or average size child's pocket. The present invention also has a connecting system for doll, clothing, and accessories readily handled by little fingers of children.

SUMMARY OF THE INVENTION

Generally, the present invention provides a flat fabric doll with a new and improved grommet fastening system for attaching reversible clothing and accessories to a doll body. For the present invention, a grommet, sometimes referred to as an eyelet, serves as a ring or edge strip inserted into an aperture passing through textile material. The present invention has a flat fabric doll with an exposed front surface with a head, a neck, and a torso bonded to a front fabric segment backed with interfacing to provide strength and stiffness. A permanent clothing item, such as a dress, bonds and joins by sewing to the doll torso presenting the doll figure fully dressed. A grommet secures through the permanent clothing item in the chest region between the shoulders and passes through all layers of the doll and the rear textile surface to which the front textile segment bonds. A decorative brad, or button threaded with a chenille stick or coated wire, having a circumference larger than the grommet, passes the chenille stick or coated wire through the grommet positioning the brad head or button to rest upon said permanent dress as a decorative accessory. The ends of the brad, chenille stick, or coated wire exit the rear textile surface and a user bends them to secure on the back. The collared design of the grommet, manufactured in metal, brass, plastic, rubber, silicone, and the like is secured to the fabric upon application.

There has thus been outlined, rather broadly, the more important features of the invention in order that the detailed description thereof that follows may be better understood and that the present contribution to the art may be better appreciated. The present invention also includes a head on a wire inserted into a grommet, independently moving limbs, loop securement, and a doll stand. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a connecting system for doll, clothing, and accessories, that has a method for constructing said doll such that the arms and legs move independently thus adding dimension to a generally flat doll.

Another object is to provide such a connecting system for doll, clothing, and accessories, that adds further dimension and attractiveness to the facial features through the use of unique materials creating greater desirability among children.

Another object is to provide such a connecting system for doll, clothing, and accessories, that has a unique doll base shape increasing the ease for positioning, holding, and carrying the doll during play.

Another object is to provide such a connecting system for doll, clothing, and accessories, that has numerous creative options for the young child's play experience.

Another object is to provide such a connecting system for doll, clothing, and accessories, that secures clothing and accessories increases creativity and decision-making skills, enhances the development of fine motor skills, and allows for more enjoyable play as items of clothing do not bend, tear, or fall off during play.

Another object is to provide such a connecting system for doll, clothing, and accessories, that has a low cost of manufacturing so the purchasing kids, parents, relatives, and organizations can readily buy the connecting system for doll, clothing, and accessories through stores and supply sources.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated and described a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
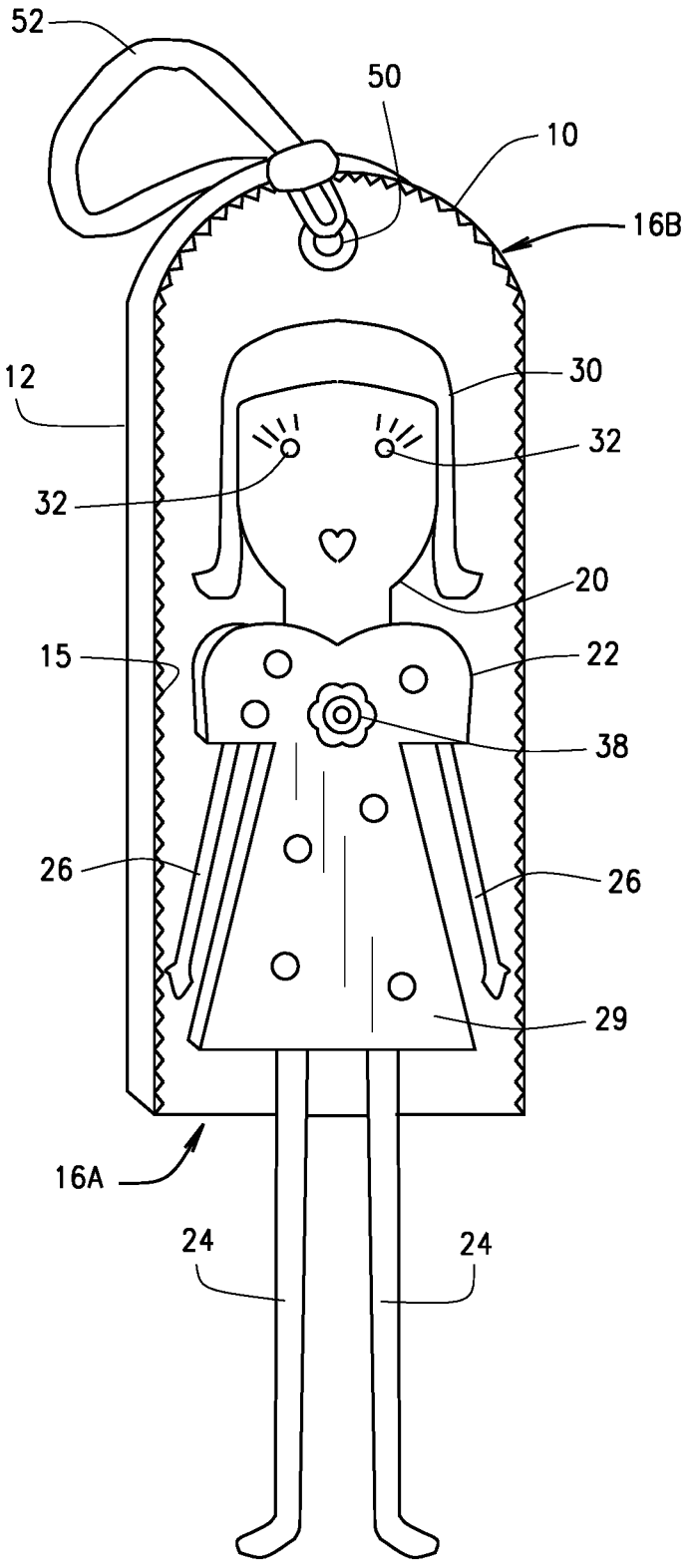
FIG. 1 shows a perspective view of the preferred embodiment of the doll constructed in accordance with the principles of the present invention.

The present invention overcomes the prior art limitations by providing a connecting system for doll, clothing, and accessories generally used by a child under the supervision of a parent or other caregiver. In the preferred embodiment of the present invention, a flat fabric doll has an exposed front surface with a head, a neck, and a torso bonded to a front fabric segment backed with interfacing to provide strength and stiffness. A permanent clothing item, in the form of a dress, bonds and joins by sewing to the doll torso presenting the doll as fully dressed at all times. A grommet secures through the permanent clothing item in the chest region between the shoulders and passes through all layers of the flat doll and the rear textile surface to which bonds the front textile surface. A decorative brad, or button threaded with a chenille stick or coated wire, having a circumference larger than the grommet, passes through the grommet positioning the brad head or button to rest upon the permanent dress as a decorative accessory. The ends of the brad, chenille stick, or coated wire exit the rear textile surface and a user bends them to secure on the back of the invention.

In accordance with another embodiment of the present invention, interchangeable reversible clothing has outer layers of differing fabric, each layer having an interfaced layer to prevent the item from bending and tearing. A grommet connects each item of interchangeable clothing at the same position as the permanent dress grommet secured on a flat doll. The reversible clothing item fastens over the permanent dress by means of passing a brad or a chenille stick through both grommets and bending the brad or the chenille stick to secure the item on the back of the invention. Alternatively, an eyelet may replace a grommet throughout this invention. When fastened, no part of the permanent dress appears visible to a user. The interchangeable fasteners, to include a variety of brads and button styles, paired with reversible clothing items, allow for a plurality of doll clothing outfits. In further accordance with the preferred embodiment, additional grommets attach on the doll figure and the front textile surface to fasten additional interchangeable accessories including belts, hats, jewelry, and hair items.

In another embodiment of the present invention, a pair of arms and a pair of legs attach on the front textile surface beneath the doll figure and extend beyond the fabric surface adding a third dimension to the relatively flat doll. Arms and legs from colorful woven materials or cording move independently and provide a degree of positioning to the flat fabric doll.

In another embodiment of the present invention, a flat padded doll secures to the front textile surface pressed around a layer of interfacing and joins by sewing to the rear textile surface along the perimeter of both surfaces for rigidity and durability. The unique shape of the invention has a rounded top edge and a straight bottom edge to position the doll upright in a doll stand or to stand by leaning against a solid surface.

In another embodiment of the invention, a grommet—located above the doll head on the base—secures and through which a loop threads for holding, carrying or suspending a doll during play or storage. The loop of stretchable material has a size to fit in a small child's hand and hang over a doorknob or on a hook type device that adheres to windows, walls, or appliances.

In another embodiment of the present invention, a flat doll has a fabric segment or loop sewn on the vertical sides to the lower third of the rear textile surface. The gap, between the fabric segment and the rear surface, receives a portion of a stand. The portion has an orientation generally parallel to the plane of the rear textile surface so that the doll appears upright to a user. The stand may have a round metal base with at least one metal upright that fits behind the fabric segment. The stand may also have a small weighted block, cylindrical or flat, with a six-inch vertical post extending upward from the center of the block. The post fits behind the fabric segment that keeps the doll standing. The rear textile surface slides downward over the vertical post holding the flat doll in an upright position, so a child may see it.

In an alternate embodiment of the present invention, the front textile surface joins by sewing to the rear textile surface on the vertical sides and the to rounded top segment. This sewn construction leaves an opening at the straight edge bottom so as the vertical post of the weighted doll stand slides between the front and rear textile surfaces, or layers, it stands the doll in an upright position. The present invention is shown as a flat fabric doll 10 comprising a fabric doll figure secured to a front textile surface 16 and subsequently bonded to a rear textile surface 12 in accordance with the principles of the present invention. The doll utilizes woven and nonwoven textiles including but not limited to cotton, polyester, felt, fleece and suede. These textiles make the doll components interchangeable and depending upon the design of said flat fabric doll. And in another alternate embodiment, the material of the doll hair secures to the doll front textile surface by means of stitching.

With reference to the drawings, FIG. 1 shows a doll figure 20 with an attached dress 22 secured to a fabric segment referenced as the front textile surface 16 or front surface. The front surface has a perimeter and a length less than the perimeter. The length generally follows the height of the doll figure during usage, generally vertically. The front surface also has rounded top edge 16*a* and a straight bottom edge 16*b* separated by the length. The bottom edge is generally perpendicular to the length. The doll figure has a head 20*a*, a neck 20*b* supporting the head and beneath it, an upper torso 20*c* beneath the neck and wider than it, and a lower torso 20*d* below the upper torso. A pair of legs 24 and a pair of arms 26 secure to the front textile surface 16 beneath the doll figure 20. The legs adhere to the front surface particularly below the lower torso and depending from the lower torso for free movement while the arms adhere proximate the upper torso, have a spacing outwardly from the neck, and each arm moves independently. The front textile surface 16 has a heat bond and sewing to a complementary textile part of the same size and shape called a rear textile surface 12. The heat bond occurs through interfacing applied to the front surface and stitched along a majority of the perimeter of the front surface. Doll hair 30 has woven material such as yarn, cording, or the like, joined by stitching to the front textile surface 16 thereby adding dimension, thickness, relief, and attractiveness to a finished flat doll 10. The doll hair operates from a hair simulating fabric stitched to the head 20. Hair accessories may permanently affix or interchange and release using the present invention's grommet system for fastening any additional items and accessories. Human facial features applied to the doll, particularly the head 20*a*, encompass a variety of materials to add interest, depth, and attractiveness. Eyes 32 may secure in place using heat fixed rhinestones, heat activated interfacing, brads, or other decorative eye like items. Eyelashes, as a facial feature, take form using permanent fabric markers, needlepoint, or printing and the mouth appears from a heart shaped brad. Facial features may also be printed on the doll's head with lead free inks. Peripheral zigzag stitching 15 on the front and rear textile surfaces adds a degree of permanent bonding and stiffness. Zigzag stitching appears as a pattern of thread making short turns in alternating directions within a defined width. The thread has an angled stair step like pattern, often seen as triangular when done in a single pass or seen as X like shape when done in two passes. A grommet 50 has its position above the doll head, as at 20, proximate the top edge 16*a*, on the finished flat doll 10 through which a loop 52 threads or connects for holding, carrying or suspending during play or storage. The loop 52 stretches and has a size to fit in the grasp of a small child's hand, to loop over a doorknob, or suspend from a hook type device that adheres to windows, walls, or appliances. The loop system provides numerous creative options for the young child's play experience. Alternatively, the grommet 50 may have the form of an eyelet.

The finished flat doll 10 has a generally two dimensional, planar form with minimal body depth. The freely moving legs 24 and arms 26 and the to materials of the hair and facial features provide added dimension, thickness, and relief to the overall finished flat doll 10. Additionally, appropriate sized beads represent bracelets that a user may thread onto the arms and legs. A user may knot them beneath to secure the beads on the limbs.

A grommet 38 connects all surfaces and layers of the flat doll 10 and secures additional clothing over the permanently attached dress 22. Grommets may have various sizes and are made of, but not limited to, metal, brass, plastic, rubber, silicone and the like, join to the front and the rear textile surfaces in additional positions as the means for securing desired accessories.

Figure 2:
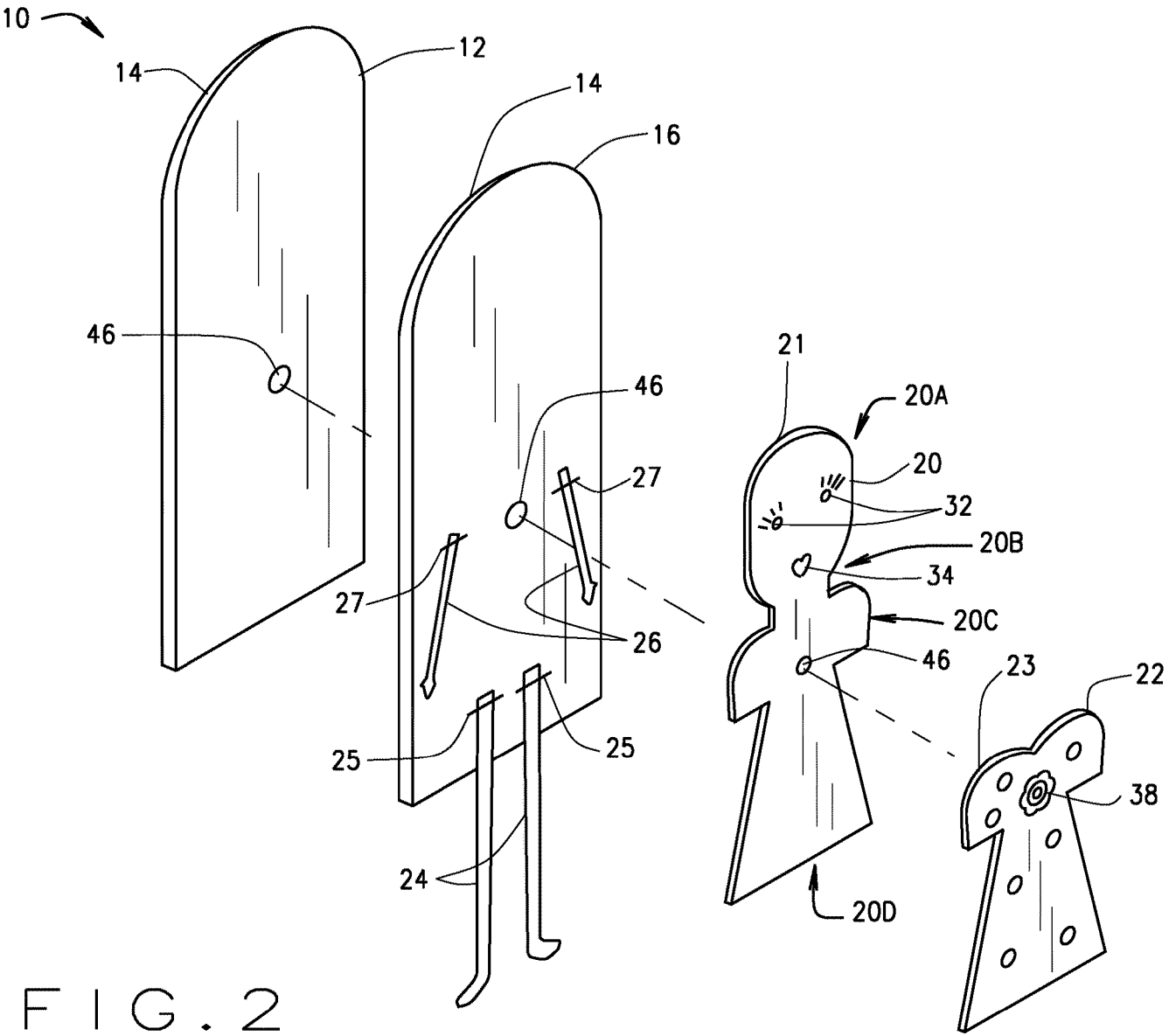
FIG. 2 provides an exploded view of the construction of the doll of FIG. 1.

Referring now to FIG. 2, a flat doll 10 appears in an exploded view of her construction. The rear textile surface 12 and the frontal textile surface 16 come from fabric segments cut of the same size and shape to correspond and to be straight across the bottom portion and rounded at the opposite top portion and may vary in color or fabric type. The two surfaces, 12, 16, have a size generally small, yet variable, approximately 2 inches in width and 6 inches in height. Each stack configured as surfaces or layers has heat bonded interfacing, such as Pellon® of Pellon, LP, Durham, N.C., of appropriate thickness affixed within to serve as padding and added depth, provide stiffness, and prevent the finished flat doll 10 from permanently bending and tearing. The front textile surface 16 has an interfacing layer as at 14 shown in FIG. 2 and generally opposite the doll figure. The interfacing cures upon application of heat, thermal activation. In the preferred embodiment, before stacking the surfaces or layers, a pair of legs 24 and a pair of arms 26, each of a woven material or cording joins to the doll's front textile surface 16 by means of stitching as at 25, 27, or applying adhesive such as pressure sensitive, peel and stick, water based glues, such as Elmer's® of Elmer's Products, Inc., Westerville, Ohio, aliphatic resins, epoxies, and the like.

The doll figure 20, cut from felt or a woven textile, then has heat bonds over the upper portion of the legs 24 and of the arms 26 on the front textile surface 16 from using an iron or the like. Further, the neck and head region of the doll figure 20 has peripheral stitching using a zigzag stitch for reinforcement. Next, the doll hair is laid over the edges of the head and is stitched in place. Facial features as described above in FIG. 1 are added by lead free ink or an adhered component.

FIG. 2 also shows the embodiment of a cut out fabric dress 22 secured with a layer of heat bonded interfacing 23 on the reverse side and bonded to the doll figure 20 by ironing or the like. The dress 22 is also known as a layer simulating clothing and it has a perimeter complimentary to the front surface. Further, the dress may also have a structure and an appearance of letters, groups of letters, and numerals to provide a visual representation of phonic concepts. The layer simulating clothing attaches to the upper torso 20*c* while the legs move freely beneath the layer simulating clothing. The bonded dress has peripheral stitching upon its perimeter using a zigzag stitch for reinforcement and attractiveness.

Then the doll front textile surface 16, containing the embodied doll figure 20 and all the embellishments thereof, bonds to the rear textile surface 12 through the attached heat bonded interfacing, that is, thermal activated interfacing that provides stiffness and padding to the invention. The rear surface has a perimeter and a length less than the perimeter. The length generally follows the height of the doll figure during usage, generally vertically. The rear surface also has its rounded top edge 16*a* and its straight bottom edge 16*b* separated by the length. The bottom edge is generally perpendicular to the length and the rear surface corresponds to the front surface in shape and in size. The resulting flat doll 10 then has stitching placed around the edges in a zigzag stitch 29 for additional securement. The front surface joins to the rear surface upon their mutual perimeters by stitching, as at 29, to a majority of the perimeter of the front surface and the rear surface so that the bottom edge remains open.

A grommet 38 secures on the permanent dress 22, or layer simulating clothing, slightly below the neckline and centered between the shoulders, the shoulders being outwardly of the neckline, and passes through all layers of the finished doll 10. The grommet extends through the clothing items, the front surface and through the rear surface. The grommet has cooperative engagement with the chenille stick or coated wire of the flexible elongated member.

Figure 3:
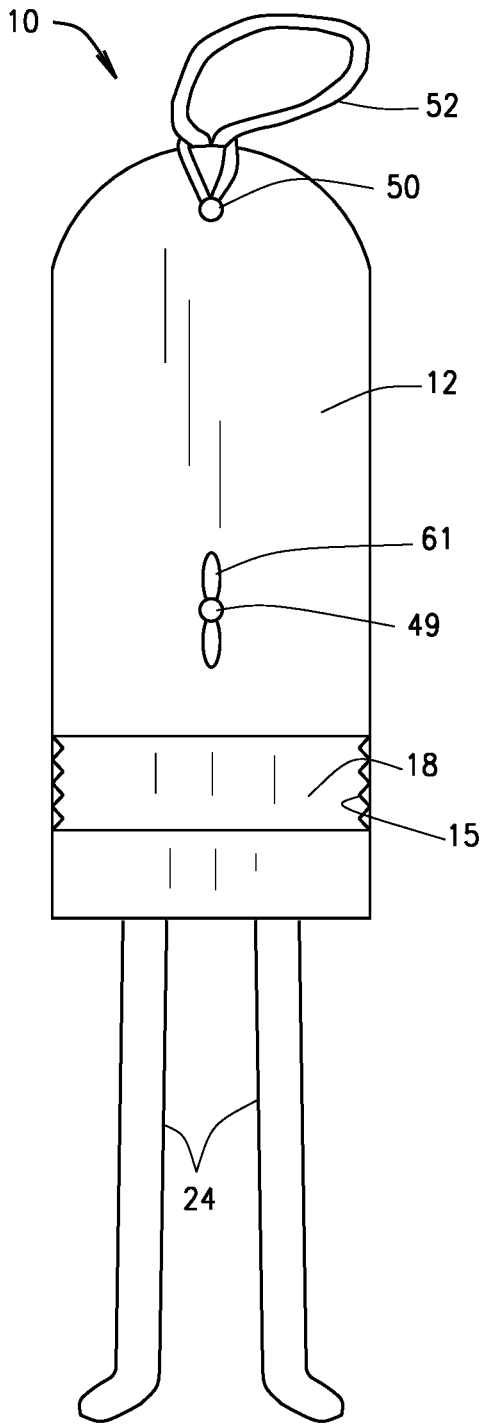
FIG. 3 illustrates a rear view of the assembled doll of FIG. 1.

Turning now to FIG. 3, a rear view of the finished flat doll 10 appears where a custom label 18 joins by stitching to the lower third of the rear textile surface 12, at its sides only, creating a loop for positioning the flat doll on a doll stand, not shown. The grommet 50 at the rounded top has a loop secured for holding or carrying the doll during play. The grommet as at 38 secures proximate the middle of the rear textile surface 12 and allows a user to fasten the interchangeable, reversible clothing items.

Figure 4:
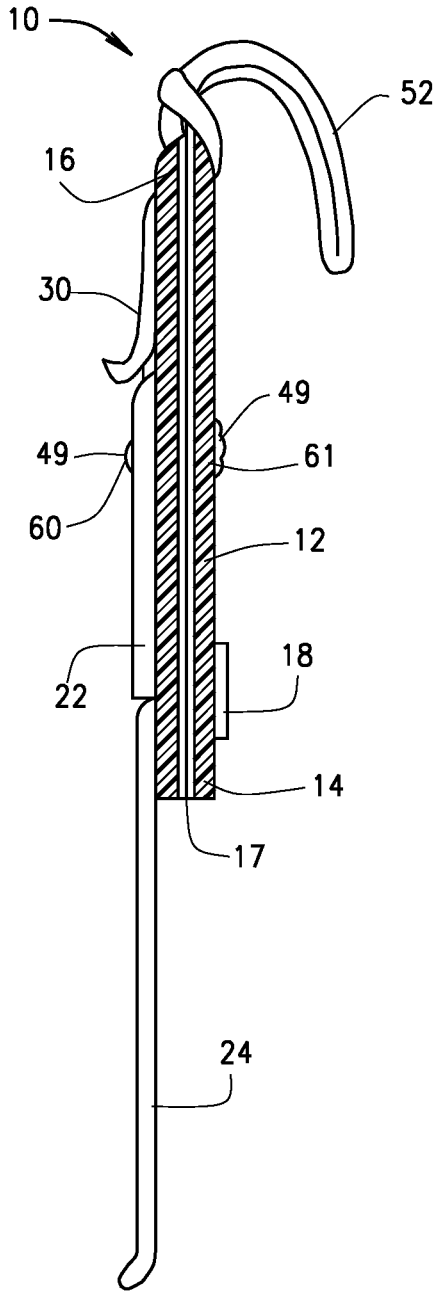
FIG. 4 describes a side elevation view of the assembled doll of FIG. 1.

Next, FIG. 4 shows a side view of the assembled flat doll 10 depicting the heat bonded interfacing 17, 14 layered between the front textile surface 16 and the rear textile surface 12. The position of textile label 18 appears on the back of the rear textile surface 12 in the lower quadrant as the means for putting the doll on a doll stand, not shown. In this view, the brad 49 or chenille stick 61 passes through the button 60 or grommet and all layers or surfaces of the flat doll and exits the rear textile surface 12 and bends to secure. FIG. 4 further shows the hair 30 and the legs 24 as attached to the front textile surface 16 and extending outwardly as to depth to the relatively flat doll. The loop 52 appears from the side as secured to the flat doll for holding the flat doll as suspended or when rolled.

Figure 5B:
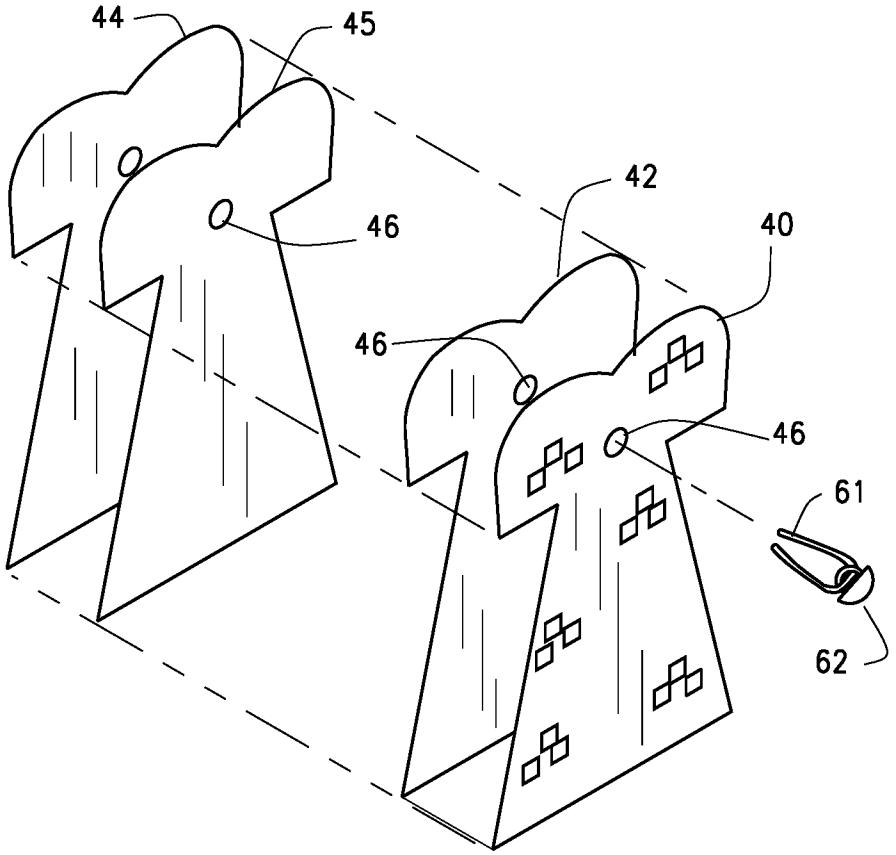
FIG. 5B illustrates an exploded view of the construction of a interchangeable, reversible clothing item and depicting the grommet fastening system using a ring back button.
Figure 5A:
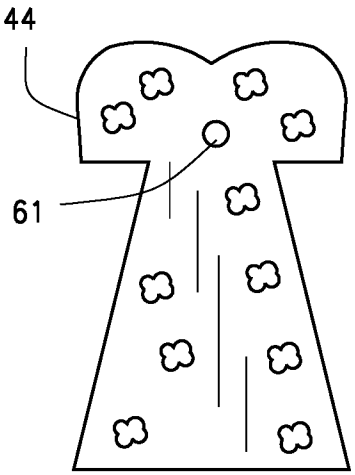
FIG. 5A shows a front view of a clothing item.

FIG. 5A shows a front view of an exemplary clothing item utilized by the invention with a dress panel as at 44 and a chenille stick as at 61.

Then FIG. 5B has an exploded view of an item of reversible clothing with a first reversible dress panel 40 and a second reversible dress panel 44 cut of complimentary shape but of diverse fabric such as in its pattern. These panels have layers of heat bonding interfacing 42, 45 secured respectively and stacked therebetween and bonded using an iron or the like. Either the first panel or the second panel may be displayed outwardly for a child to see. A grommet 46, or eyelet, passes through all layers and surfaces and attaches to the reversible dress in the exact position of the permanent fabric dress 22 attached to the doll figure 20. Alternately, stitching occurs around the periphery of the reversible clothing item for reinforcement and visual interest. The reversible dress fastens to the finished flat doll 10 by passing a flexible elongated member, such as a brad 49 of FIG. 4, or button threaded with a chenille stick or coated wire 61, through the grommet 46 on the reversible dress similar to grommet 38 on the finished doll 10 exiting the back and bending to secure. The grommet 46 has particularly a cap 62, or head, like shape that receives a flexible elongated member such as the chenille stick as at 61, coated wire, or brad. The cap includes a button with at least two button holes, a button with a button back with its own ring, and a brad with its own prongs. The cap prevents the flexible elongated member from passing through the simulated clothing layer 22, pulling through the invention, and exiting the rear surface.

This new attachment system allows the permanent dress 22 to have complete covering by the reversible dress or other clothing item in the form of shirt, skirt, pant, and dress of length. Additional clothing items of low cost, and their reversible nature and interchangeable fasteners adds to the plurality of outfits and the increased enjoyment for the child.

FIG. 5B also shows a chenille stick, or pipe cleaner, or thin piece of coated wire 61 of approximate 3 to 4 inches in length threaded through a ringed button back 62. The chenille stick has two portions, one portion is approximately ½ inch longer than the other portion upon exiting the ringed button back 62. The tips of the chenille stick or wire 61 bend inwardly thus, eliminating sharp points. In another embodiment, the portions of chenille sticks or wire 61 twist together to form one cohesive length to pass more readily through the grommets 38, 46 and bend upward to secure. As a second embodiment, the portions of the chenille stick 61 pass through the grommets 38, 46 independently and one portion bends upwardly and the other portion downwardly to secure previously shown in FIG. 3.

Figure 6:
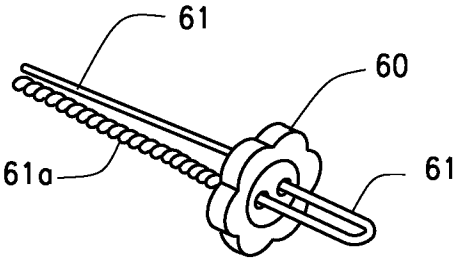
FIG. 6 provides is a perspective view of a button containing apertures for threading an accessory or as a fastener.

Referring now to FIG. 6, more particularly, the grommet 38 previously shown operates as a cap upon a chenille stick or a length of coated wire 61 threads through a button 60 having at least two apertures for securing the bent wire beyond the two portions. This chenille stick then secures the interchangeable clothing by means of the grommet system. The length of coated wire has two portions shown to illustrate surface conditions. Those conditions include a coating upon the wire shown plainly and a chenille, as at

61*a*, woven into the wire or adhered to the wire. The chenille provides a fuzzy texture often scene in pipe cleaners.

Figure 7:
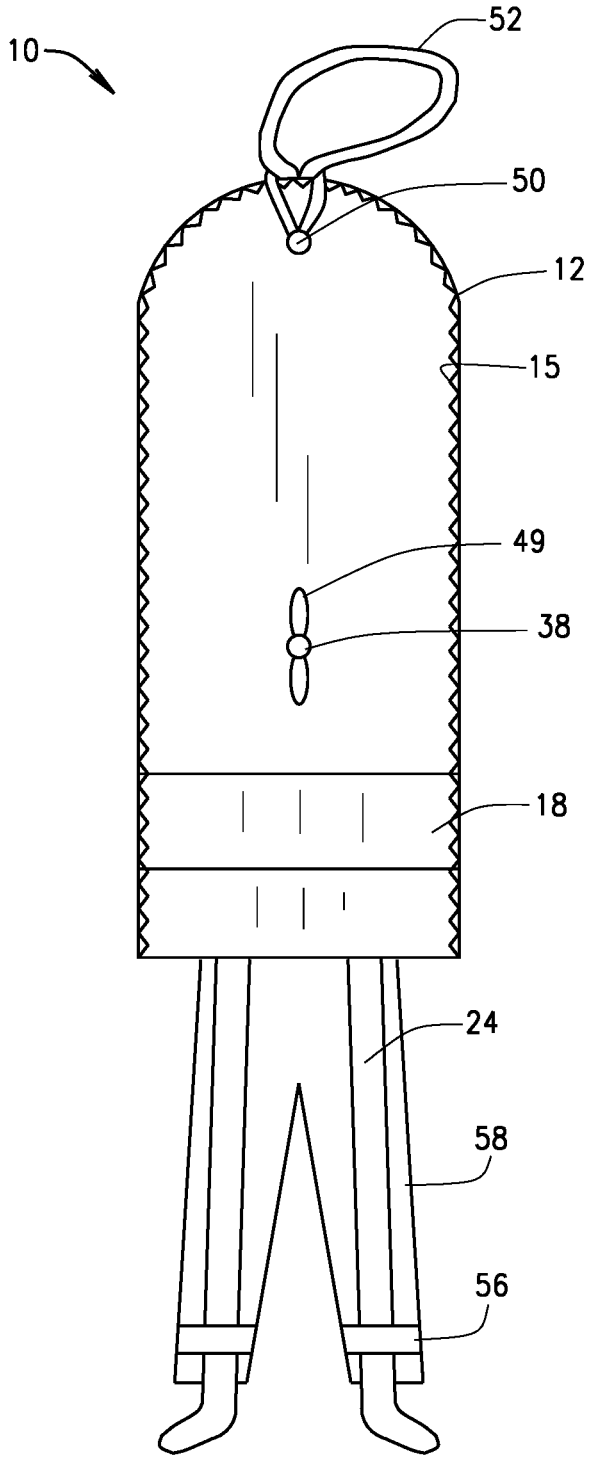
FIG. 7 shows a rear view of the legs secured to an item of interchangeable clothing that extends beyond a finished doll base.

In FIG. 7, the reverse face of the rear textile surface 12 shows the bottom portion of each leg 24 secured to an item of interchangeable clothing. This securement inhibits leg movement independent of the clothing item 58 that extends beyond the base of finished flat doll 10. Securement includes a piece of elastic or stretchable textile strip 56 stitched to a lower section of the clothing item through which the legs 24 pass to unite as a cohesive unit. An alternative securement includes a chenille stick as at 61*a* wrapped around the garment and the limbs, such as the legs of the doll.

The invention also includes an alternate embodiment where a label in form of a loop 18 secures a doll 10 to a doll stand where a user slips the loop over an upright pole of a stand, not shown. The label has an alternate form of a sleeve sewn upon the rear surface opposite the front surface. The sleeve remains closed upon one end towards the top edge and remains open on the opposite end towards the bottom edge. The sleeve receives a stand for orienting the doll in an upright manner.

Figure 8:
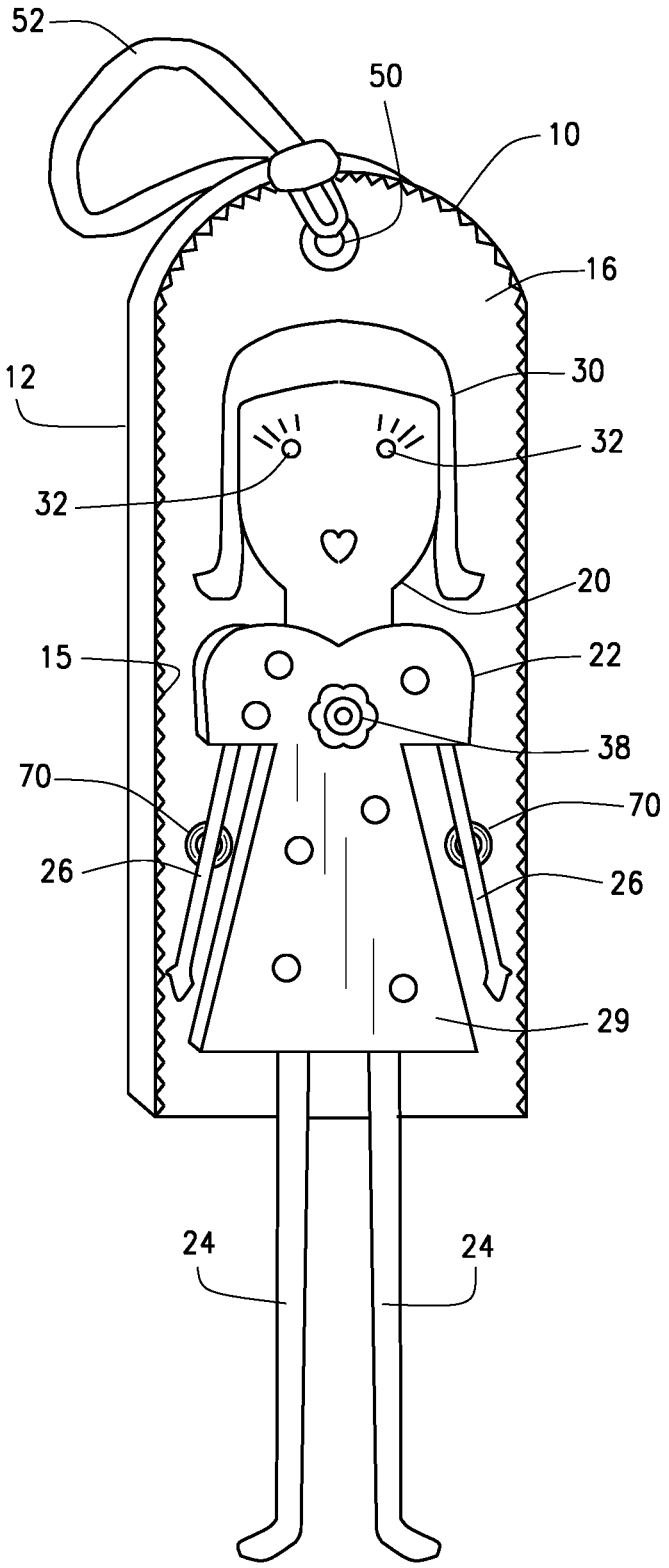
FIG. 8 shows a perspective view of an alternate embodiment of the present invention; and, FIG. 9 illustrates an exploded view of the alternate embodiment.

In an alternate embodiment shown in FIG. 8, the invention has a doll figure 20 with dress 22 secured to the frontal textile surface 16 as above. The doll has its pair of legs 24 and pair of arms 26 also secured to the front textile surface 16. The front textile surface 16 has its heat bond and sewn connection to the rear textile surface 12. The doll has its hair 30 from woven material as previously described. Hair accessories may permanently affix or interchange and release using the previously described grommet system. The doll may include facial features from a variety of materials to add interest, depth, and attractiveness while the eyes 32 secure using heat fixed rhinestones, stitched googly eyes, and other eye decorations. Peripheral zigzag stitching 15 along the edges of the front and rear textile surfaces adds to the permanent bonding and stiffness. The grommet 50 has its position above the doll's head on the finished flat doll 10 through which a loop 52 threads for holding, carrying, or suspending during play or storage. The finished flat doll 10 has its two dimensional planar form while the freely moving legs 24 and arms 26 and the materials of the hair and facial features give added relief and thickness to the overall finished flat doll 10. The grommet 38 extends through all surfaces and layers of the flat doll 10 as previously described in FIG. 1. Grommets of varied size and comprised of, but not limited to, metal, brass, plastic, rubber, silicone and the like join to the textile surfaces in additional positions as the means for securing desired accessories.

This alternate embodiment has two second grommets 70 placed upon the front surface 16, extending through the invention, and opening through the rear surface 12. The second grommets have a position approximate the waist of a the dress 22, that is, beneath the arms 26 at their approximate elbows. The grommets have an opening diameter sufficient to admit a ribbon, a small piece of leather, thread, and the like to serve as a belt upon the doll's figure. The opening diameter of the second grommets is generally proportional to that of the grommet 50 that receives the loop 52 as previously described. More particularly, the opening diameter of the second grommet is from about one half of the thickness of the front surface combined with the rear surface to about twice that combined thickness. The arms 26 generally rest upon the second grommets 70 though a user may readily move the arms outwardly from the second grommets for usage. Preferably, the second grommets are mutually spaced apart about the centerline of the doll.

Figure 9:
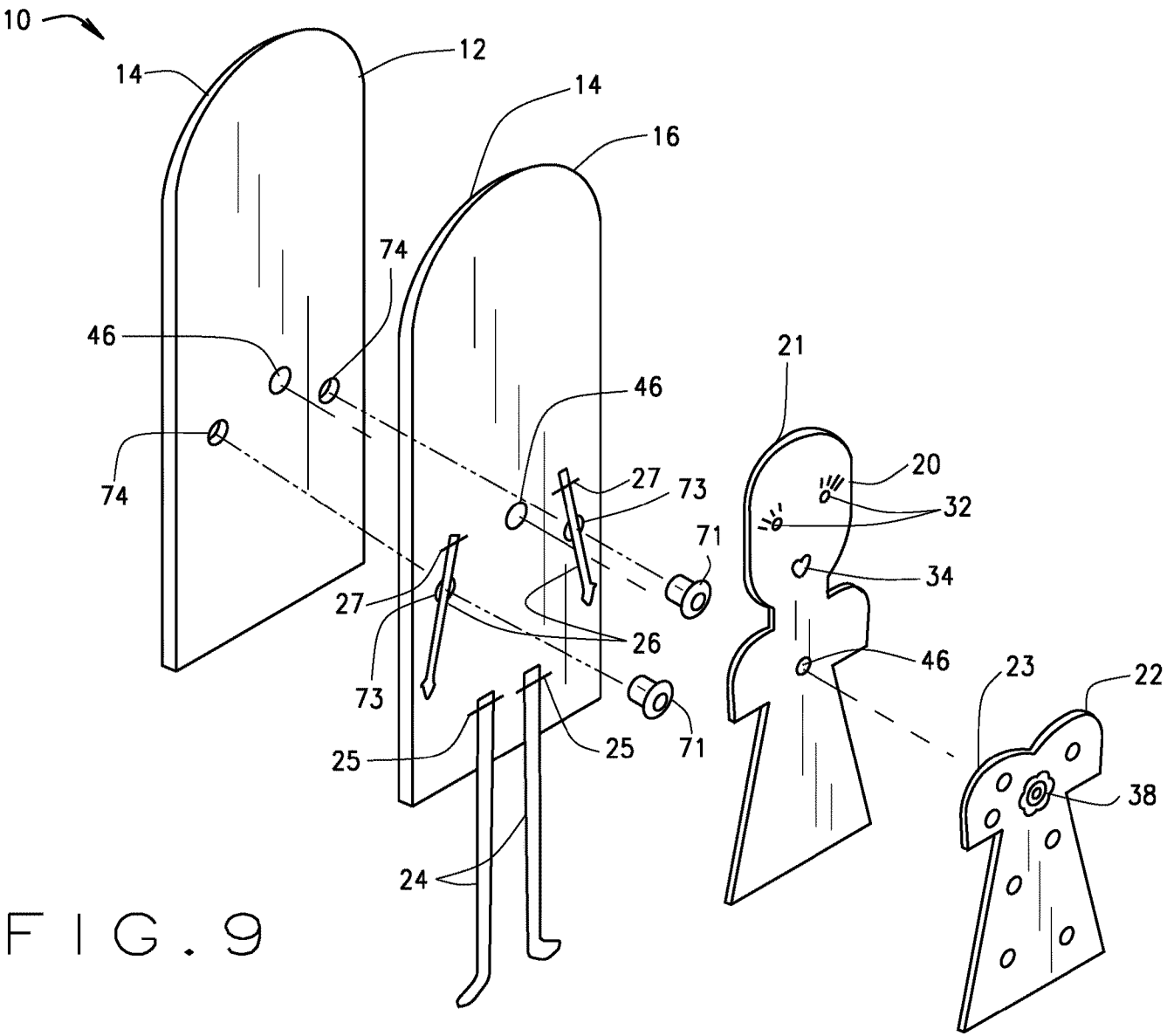

FIG. 9 shows the alternate embodiment of the invention in an exploded view similar to that of FIG. 2. The second grommets has a cylindrical shape with a brimmed head as shown at 71. During assembly of this embodiment, the cylindrical shape inserts through a second aperture 73 in the front surface 16 and into a coaxial third aperture 74 in the rear surface 12. The cylindrical shape is then compressed or crimped, not shown, into a compact form gripping the adjacent surface material. Thus the front surface has two second apertures and the rear surface also has two third apertures. The second apertures and the third apertures appear from stamping, incising, and like processes to form them in the front surface and the rear surface respectively. In a further alternate embodiment, the second apertures and the third apertures arise from linear incisions. Those incisions then receive the second grommets 70 as described previously or as eyelets fitted tightly into the second apertures and the third apertures.

From the aforementioned description, a connecting system for doll, clothing, and accessories has been described. The connecting system for doll, clothing, and accessories is uniquely capable of securing layers of clothing using a releasable and flexible elongated member, such as a chenille stick with a head, placed through one or more grommets. The connecting system for doll, clothing, and accessories has grommets in select positions upon clothing items, accessories, and the doll's torso so the grommets appear in registration and the clothing fits properly upon the doll. The connecting system for doll, clothing, and accessories, and its various components may be manufactured from many materials, including but not limited to, cotton, wool, polyester, steel, aluminum, brass, bronze, polymers, high density polyethylene, polypropylene, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

While the present invention has description above of its preferred embodiment, it will be understood that it is not intended to limit the invention to these embodiments. Instead, it is intended to cover all alternatives, modifications and equivalents as may be included within the spirit and scope of the present invention as defined by the appended claims.

I claim:

1. An amusement device for children comprising:

a front surface and an opposite rear surface;

said front surface having a head, a neck beneath said head, an upper torso beneath said neck and generally wider than said neck, a lower torso opposite said upper torso, and thermal activated interfacing affixed to said front surface, said front surface having a perimeter and a length, and said thermal activated interfacing stitched to a majority of said perimeter of said front surface perimeter;

said front surface having a top edge and an opposite bottom edge, said top edge being rounded and said bottom edge being straight and perpendicular to the length of said front surface;

said rear surface having a perimeter with a top edge and an opposite bottom edge and a length that correspond to said front surface;

said front surface bonded to said rear surface upon heating said thermal activated interfacing wherein said interfacing provides stiffness and padding to said amusement device;

a layer simulating clothing having thermal activated interfacing and a perimeter, wherein said layer simulating clothing affixes to said upper torso, and said layer simulating clothing is stitched to said front surface;

a plurality of human facial features affixed to said head by one of needlepoint stitching, thermal activated interfacing, and brads;

doll hair affixed to said head by stitching;

two legs of fabric adhered to said front surface and depending from said lower torso;

two arms of fabric adhered to said front surface, said arms being spaced apart and depending from said upper torso;

said front surface further joined to said rear surface upon their mutual perimeters by stitching together about the majority of their mutual perimeters such that an opening is formed in the amusement device between the bottom edges of the front surface and the rear surface;

at least one grommet extending through the amusement device from the layer simulating clothing to said rear surface;

at least one grommet extending through said front surface and said rear surface proximate said rounded edges, and a loop connecting to said at least one grommet joining said front surface proximate said rounded edge; and, a cap upon a flexible elongated member wherein said flexible elongated member passes through said at least one grommet extending through the amusement device and wherein said cap prevents said flexible elongated member from exiting said rear surface.

2. The amusement device for children of claim 1 further comprising:

said legs extending outwardly from said bottom edge and beneath said layer simulating clothing.

3. The amusement device for children of claim 1 further comprising:

said arms affixed to said upper torso of said front surface and extending outwardly from said upper torso.

4. The amusement device for children of claim 1 further comprising:

said layer simulating clothing includes a dress, said dress having the perimeter, and said dress stitched along its perimeter to said front surface.

5. The amusement device for children of claim 1 further comprising:

said cap having at least two holes receiving said flexible elongated member wherein said flexible elongated member is either a coated wire or a chenille stick engaging with said at least one grommet extending through the amusement device.

6. An amusement device comprising:

a front textile surface and an opposite rear textile surface, said front textile surface being planar and said rear textile surface being planar, and, said front textile surface and said rear textile surface being mutually parallel;

said front textile surface having a head, a neck beneath said head, an upper torso beneath said neck and of greater width than said neck, a lower torso opposite said upper torso, and thermal activated interfacing affixed to said front textile surface opposite said upper torso, said front textile surface having a perimeter and a length and said thermal activated interfacing stitched to a majority of said perimeter of said front textile surface;

said front textile surface perimeter having a top edge and an opposite bottom edge, said top edge being rounded and said bottom edge being straight and perpendicular to the length of said front textile surface;

said rear textile surface having a perimeter with a top edge and an opposite bottom edge, said top edge being rounded and said bottom edge being straight and perpendicular to the length of said rear textile surface;

said front textile surface bonded to said rear textile surface upon heating said thermal activated interfacing wherein said interfacing provides stiffness and padding to said combination amusement device;

a layer simulating clothing having thermal activated interfacing and a perimeter, wherein said layer simulating clothing affixes to said upper torso and is sewn to said front textile surface;

two legs of fabric adhered to said front surface and depending from said lower torso;

two arms of fabric adhered to said front surface, said arms being spaced apart and depending from said upper torso;

said front textile surface further joined to said rear textile surface upon their mutual perimeters by stitching together about the majority of their mutual perimeters such that an opening is formed in the amusement device between the bottom edges of the front surface and the rear surface;

at least one grommet extending through the amusement device from the layer simulating clothing to said rear surface;

at least one grommet extending through said front surface and said rear surface proximate said rounded edges, and a loop connecting to said at least one grommet joining said front surface proximate said rounded edge; and, a cap upon a flexible elongated member wherein said flexible elongated member passes through said at least one grommet joining said layer simulating clothing and wherein said cap prevents said flexible elongated member from exiting said rear textile surface wherein said flexible elongated member is either a coated wire or a chenille stick engaging with said at least one grommet extending through the amusement device.

7. The amusement device of claim 6 further comprising:

a plurality of human facial features affixed to said head by one of needlepoint stitching, and thermal activated interfacing; and, doll hair affixed to said head by stitching.

8. The amusement device of claim 6 further comprising:

said legs affixing to said front surface and extending outwardly from said bottom edge and beneath said layer simulating clothing.

9. The amusement device of claim 6 further comprising:

said arms affixing to said upper torso of said front surface and extending outwardly from said upper torso.

10. The amusement device of claim 6 further comprising:

said legs affixing to said front surface and extending outwardly from said bottom edge beneath said layer simulating clothing; and, said arms affixing to said upper torso of said front surface and extending outwardly from said upper torso.

11. The amusement device of claim 6 further comprising: said cap being a button with at least two button holes receiving said flexible elongated member.

* * * * *